US009640096B2

(12) United States Patent
Akwei et al.

(10) Patent No.: US 9,640,096 B2
(45) **Date of Patent: *May 2, 2017**

(54) TRAFFIC DIRECTION ASSEMBLY

(71) Applicants: Adote G. Akwei, Parkville, MD (US); Edoh K. Akwei, Parkville, MD (US)

(72) Inventors: Adote G. Akwei, Parkville, MD (US); Edoh K. Akwei, Parkville, MD (US)

( * ) Notice: Subject to any disclaimer, the term of this patent is extended or adjusted under 35 U.S.C. 154(b) by 210 days.

This patent is subject to a terminal disclaimer.

(21) Appl. No.: 14/574,643

(22) Filed: Dec. 18, 2014

(65) Prior Publication Data

US 2016/0180752 A1 Jun. 23, 2016

(51) Int. Cl.
*G09F 13/04* (2006.01)
*G09F 21/02* (2006.01)
*G09F 27/00* (2006.01)

(52) U.S. Cl.
CPC ..... *G09F 21/026* (2013.01); *G09F 13/04* (2013.01); *G09F 21/02* (2013.01); *G09F 27/007* (2013.01)

(58) Field of Classification Search
CPC ..... G09F 13/00
USPC ..... 340/908, 321, 332, 326
See application file for complete search history.

(56) References Cited

U.S. PATENT DOCUMENTS 3,810,091 A 5/1974 Hoover
D330,686 S 11/1992 Campagna
5,276,424 A * 1/1994 Hegemann ..... F21L 11/00 340/321
5,687,500 A 11/1997 Lamparter
5,694,110 A * 12/1997 Clifford ..... G08B 5/006 116/63 P
D405,377 S 2/1999 Davis
6,147,623 A * 11/2000 Rippen ..... G09F 27/00 340/907
6,198,410 B1 3/2001 White et al.
6,363,641 B1 * 4/2002 Martinez ..... G09F 21/02 40/586
7,233,259 B2 6/2007 Gibson et al.
2003/0033739 A1 * 2/2003 Tingle ..... G09F 13/04 40/564
2006/0012486 A1 1/2006 Gibson et al.
2006/0061487 A1 * 3/2006 Heap ..... G09F 13/22 340/908
2007/0205917 A1 * 9/2007 Nickson ..... G09F 21/02 340/907

* cited by examiner

*Primary Examiner* — Brent Swarthout

(57) ABSTRACT

A traffic direction assembly includes a pole. A housing is coupled to the pole. Each of a front wall and a back wall of the housing has a translucent section extending laterally across an entire width of each of the front wall and back wall. A control circuit is positioned within the housing. A plurality of light emitters is coupled to the housing, making the housing easily visible to the traffic. A pair of speakers is coupled to the housing to emit an audible warning to the traffic. An actuator is coupled to the pole and the control circuit. A power supply is positioned within the pole. A plurality of photovoltaic cells is coupled to the outer wall of housing to be exposed to sunlight. Each of the photovoltaic cells is electrically coupled to the power supply such that the photovoltaic cells charge the power supply.

5 Claims, 4 Drawing Sheets

TRAFFIC DIRECTION ASSEMBLY

BACKGROUND OF THE DISCLOSURE

Field of the Disclosure

The disclosure relates to direction devices and more particularly pertains to a new direction device for making a user visible while directing traffic.

SUMMARY OF THE DISCLOSURE

An embodiment of the disclosure meets the needs presented above by generally comprising a pole that has an outer surface extending between each of a top end and a bottom end of the pole. A housing is coupled to the pole to be elevated above the user when the user holds the pole, making the housing visible to traffic. The housing has an outer wall extending between a front wall and a back wall of the housing. Each of the front wall and the back wall has a translucent section extending laterally across an entire width of each of the front wall and back wall. A control circuit is positioned within the housing. A plurality of light emitters is coupled to the housing. The light emitters illuminate the housing to make the housing easily visible to the traffic. Each of the light emitters is electrically coupled to the control circuit. A pair of speakers is coupled to the housing to emit an audible warning to the traffic. Each of the speakers is electrically coupled to the control circuit. An actuator is coupled to the pole. The actuator is electrically coupled to the control circuit. A power supply is positioned within the pole. The power supply is electrically coupled to the actuator. The power supply comprises a plurality of batteries. A plurality of photovoltaic cells is coupled to the outer wall of housing to be exposed to sunlight. Each of the photovoltaic cells is electrically coupled to the power supply such that the photovoltaic cells charge the power supply.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
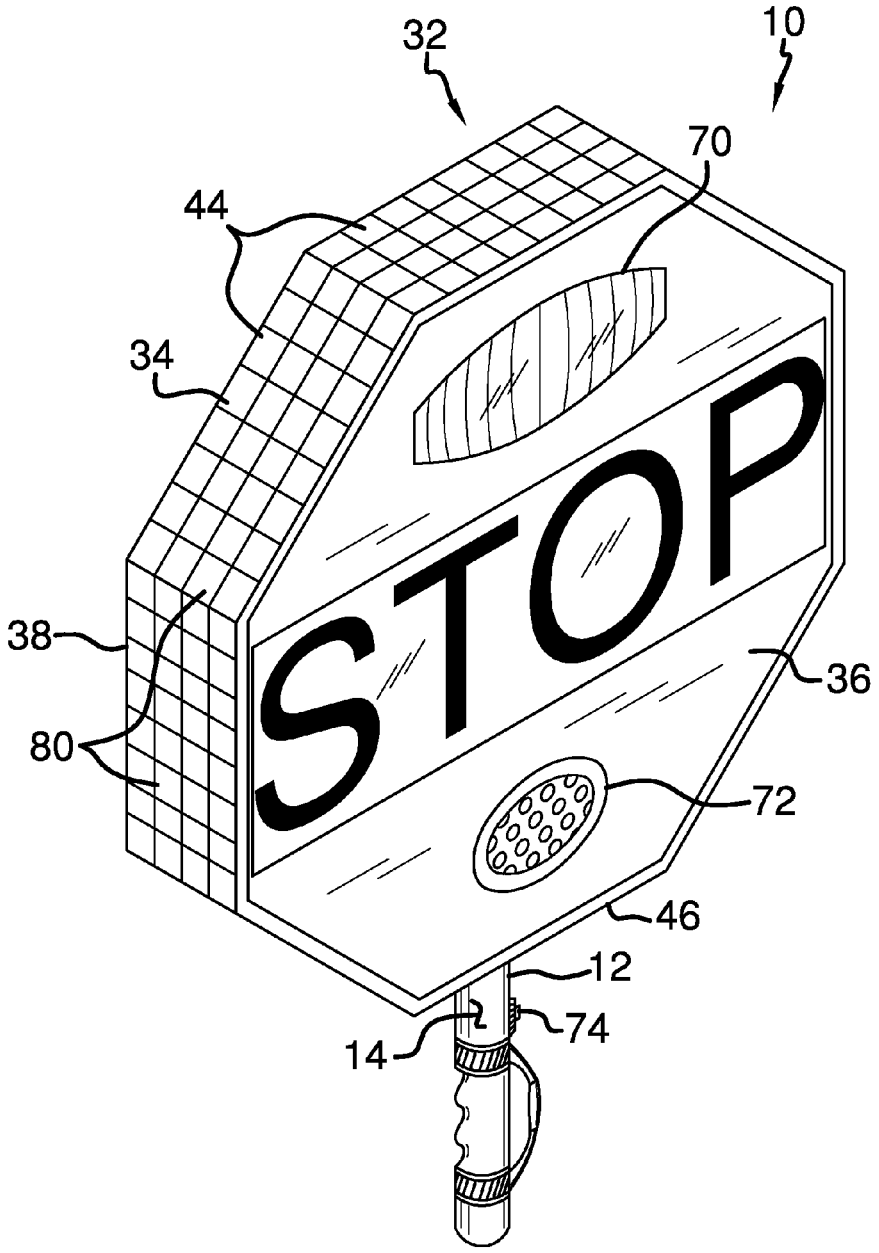
FIG. 1 is a perspective view of a traffic direction assembly according to an embodiment of the disclosure.
Figure 2:
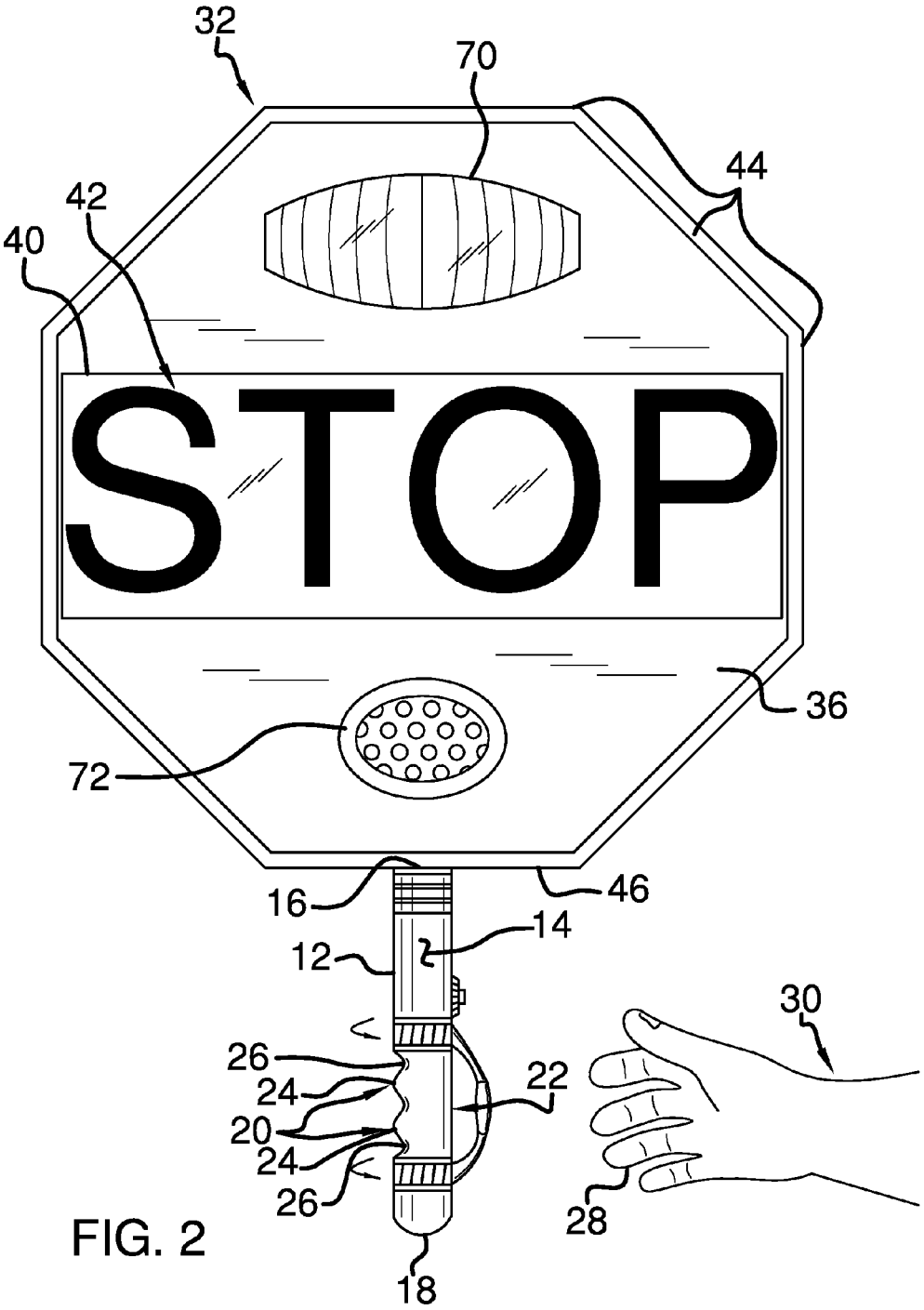
FIG. 2 is a front view of an embodiment of the disclosure.
Figure 3:
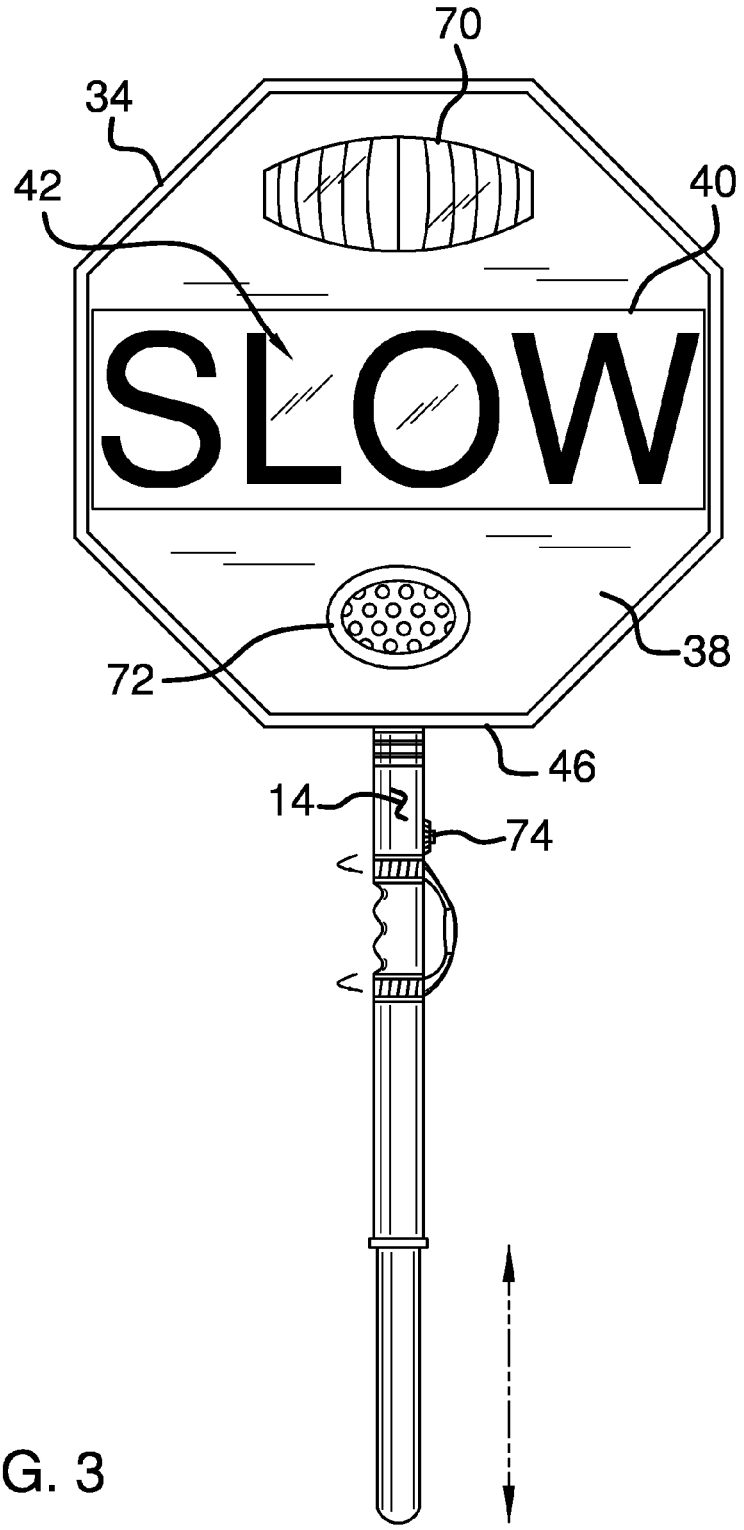
FIG. 3 is a back view of an embodiment of the disclosure.
Figure 4:
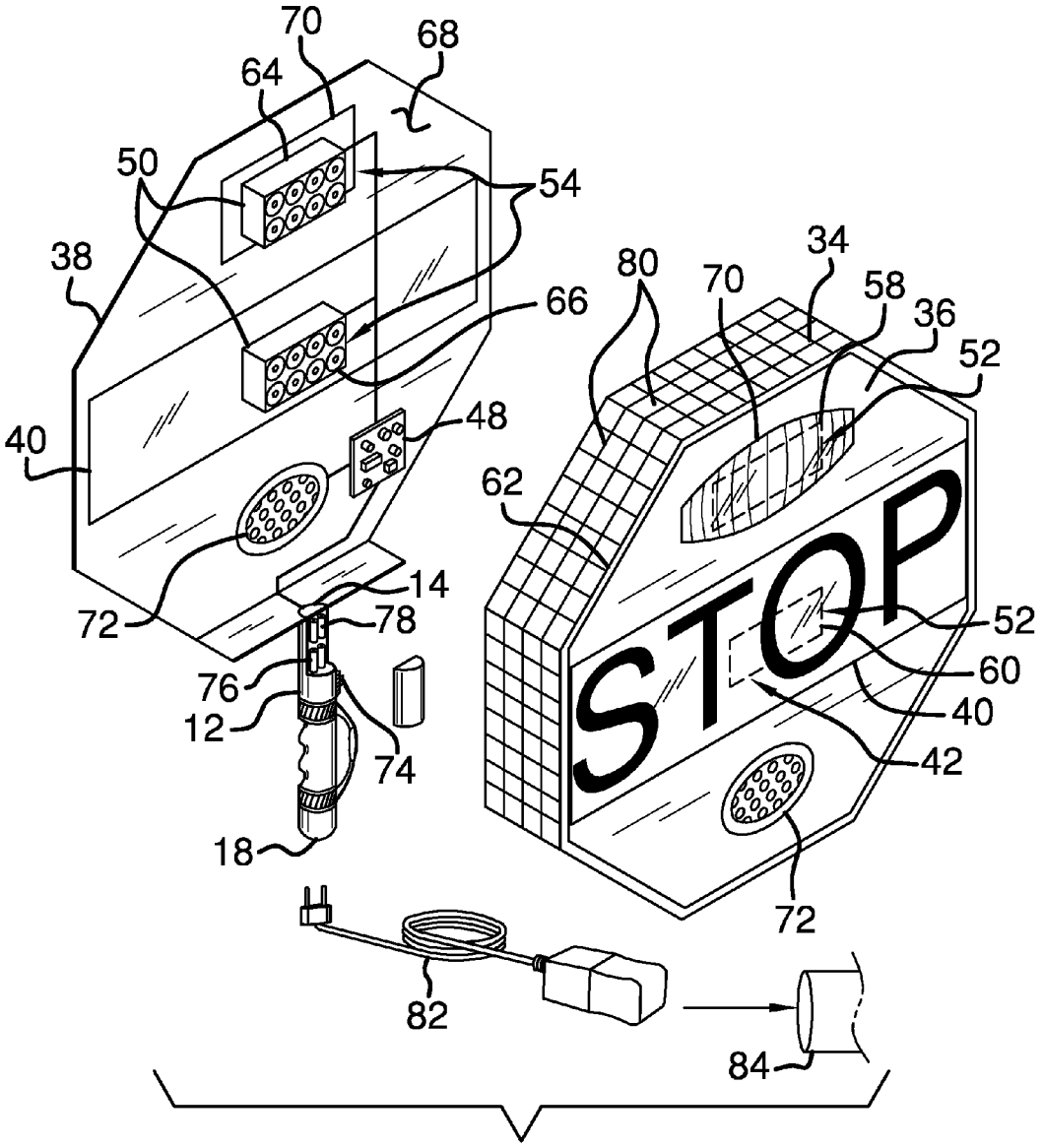
FIG. 4 is an exploded perspective view of an embodiment of the disclosure.

With reference now to the drawings, and in particular to FIGS. 1 through 4 thereof, a new direction device embodying the principles and concepts of an embodiment of the disclosure and generally designated by the reference numeral 10 will be described.

As best illustrated in FIGS. 1 through 4, the traffic direction assembly 10 generally comprises a pole 12 that has an outer surface 14 extending between each of a top end 16 and a bottom end 18 of the pole 12. The outer surface 14 has a plurality of undulating curves 20 positioned proximate the bottom end 18 to define a gripping portion 22 of the pole 12. The gripping portion 22 of the pole is rotatable along a longitudinal axis extending through the top end 16 and the bottom end 18. The undulating curves 20 are evenly spaced apart and distributed upwardly from the bottom end 18 to define an alternating sequence of peaks 24 and valleys 26. The gripping portion 22 may be gripped by fingers 28 of a user 30 having each of the user's fingers 28 positioned within an associated one of the valleys 26.

A housing 32 is coupled to the pole 32 to be elevated above the user 30 when the user 30 holds the pole 12, making the housing 32 visible to traffic. The housing 32 has an outer wall 34 extending between a front wall 36 and a back wall 38 of the housing 32. Each of the front wall 36 and the back wall 38 has a respective translucent section 40 extending laterally across an entire width of each of the front wall 36 and back wall 38. The translucent sections 40 are centrally positioned on each of the front wall 36 and the back wall 38.

Each of the translucent sections 40 has indicia 42 printed thereon such that the indicia 42 are visible to traffic. The indicia 42 may comprise the word STOP. Each of the front wall 36 and the back wall 38 has a plurality of intersecting sides 44, giving the housing 32 an octagonal shape. A bottom side 46 of the housing 32 is coupled to the top end 16 of the pole 12.

A control circuit 48 is positioned within the housing 32. The control circuit 48 may include a processor of any conventional design. A plurality of light emitters 50 is coupled to the housing 32. The light emitters 50 illuminate the housing 32, making the housing easily visible to the traffic. Each of the light emitters 50 is electrically coupled to the control circuit 48.

The light emitters 50 comprise a front set 52 and a back set 54 of the light emitters. Each of the front 52 and back 54 sets of light emitters includes a pair of light emitters 50. Each of a first one 58 and a second one 60 of the front set of light emitters 52 is coupled to an inside surface 62 of the front wall 36, selectively illuminating the indicia 42 on the front wall 36. Each of a first one 64 and a second one 66 of the back set 54 of light emitters is coupled to an inside surface 68 of the back wall 38, selectively illuminating the indicia 42 on the back wall 38. Each of the first light emitters 58,64 of the front set 52 and the back set 54 of light emitters are positioned on an associated one of the translucent sections 40.

A pair of lenses 70 is coupled to the housing 32 such that the lenses 70 are illuminated by the light emitters 50. Each of the lenses 70 is positioned on an associated one of the front wall 36 and the back wall 38. Each of the lenses 70 is aligned with an associated one of the second light emitters 60,66 of an associated one of the sets 52,54 of light emitters. Each of the light emitters 50 may comprise an LED or the like. The second light emitters 60,66 of each of the sets 52,54 of light emitters may flash repeatedly in the convention of a strobe.

A pair of speakers 72 is coupled to the housing 32 to emit an audible warning to the traffic. Each of the speakers 72 is electrically coupled to the control circuit 48. Each of the speakers 72 is positioned on an associated one of the front wall 36 and the back wall 38 of the housing 32. Additionally, each of the speakers 72 is positioned proximate the bottom side 46 of the housing 32. The audible warning may comprise a siren or other similar audible warning.

An actuator 74 is coupled to the pole 12. The actuator 74 is electrically coupled to the control circuit 48. The actuator 74 is engaged by the user 30 to selectively actuate and de-actuate the control circuit 48. The actuator 74 is actuatable to actuate the light emitters 50 and the speakers 72 independently or simultaneously.

A power supply 76 is positioned within the pole 12. The power supply 76 is electrically coupled to the actuator 74. The power supply 76 may comprises a plurality of batteries 78. A plurality of photovoltaic cells 80 is coupled to the outer wall 34 of the housing 32 to be exposed to sunlight. Each of the photovoltaic cells 76 is electrically coupled to the power supply 76 such that the photovoltaic cells 76 charge the power supply 76. The photovoltaic cells 76 may comprise solar panels or the like.

A charger 82 is provided. The charger 82 is electrically coupled between the power supply 76 and a power source 84. The power source 84 may be a vehicle cigarette lighter or the like. The charger 82 charges the power supply.

In use, the user 30 holds the gripping portion 22 of the pole 12 to direct traffic near a pedestrian crosswalk. The light emitters 50 and the speakers 72 give an additional warning to traffic that a pedestrian is crossing a roadway. Additionally, the light emitters 50 make the user 30 visible to traffic over a greater distance than an conventional sign, allowing traffic a safe amount of reaction time with regard to the pedestrian.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A traffic direction assembly configured to be gripped by a user, said assembly comprising:

a pole having an outer surface extending between each of a top end and a bottom end of said pole;

a housing coupled to said pole such that said housing is configured to be elevated above the user when the user holds said pole such that said housing is visible to traffic, said housing having an outer wall extending between a front wall and a back wall of said housing, each of said front wall and said back wall having a translucent section extending laterally across an entire width of each of said front wall and back wall, said translucent sections being centrally positioned on each of said front wall and said back wall, each of said translucent sections having indicia printed thereon such that said indicia is configured to be visible to traffic;

a control circuit positioned within said housing;

a plurality of light emitters coupled to said housing, said light emitters illuminating said housing wherein said light emitters are configured to make said housing easily visible to the traffic, each of said light emitters being electrically coupled to said control circuit, said light emitters comprising a front set and back set of light emitters, each of said front and back sets of light emitters including a pair of light emitters, each of a first one and a second one of said front set of light emitters being coupled to an inside surface of said front wall such that said indicia on said front wall is illuminated, each of a first one and a second one of said set of light emitters being coupled to an inside surface of said back wall such that said indicia on said back wall is illuminated;

a pair of lenses coupled to said housing such that said lenses are illuminated by said light emitters, each of said lenses being positioned on an associated one of said front wall and said back wall, each of said lenses being aligned with said second one of an associated one of said sets of light emitters;

a pair of speakers coupled to said housing wherein said speakers are configured to emit an audible warning to the traffic, each of said speakers being electrically coupled to said control circuit;

an actuator coupled to said pole, said actuator being electrically coupled to said control circuit;

a power supply positioned within said pole, said power supply being electrically coupled to said actuator, said power supply comprising a plurality of batteries; and a plurality of photovoltaic cells coupled to said outer wall of housing wherein said photovoltaic cells are configured to be exposed to sunlight, each of said photovoltaic cells being electrically coupled to said power supply such that said photovoltaic cells charge said power supply.

2. The assembly according to claim 1, wherein said outer surface having a plurality of undulating curves positioned proximate said bottom end to define a gripping portion of said pole, said undulating curves being evenly spaced apart and distributed upwardly from said bottom end to define an alternating sequence of peaks and valleys such that said gripping portion is configured to be gripped by fingers of the user having each of the user's fingers positioned within an associated one of said valleys.

3. The assembly according to claim 1, wherein each of said front wall and said back wall having a plurality of intersecting sides such that said housing has a octagonal shape, a bottom side of said housing being coupled to said top end of said pole.

4. The assembly according to claim 1, further comprising each of said speakers being positioned on an associated one of said front wall and said back wall.

5. A traffic direction assembly configured to be gripped by a user, said assembly comprising:

a pole having an outer surface extending between each of a top end and a bottom end of said pole, said outer surface having a plurality of undulating curves positioned proximate said bottom end to define a gripping portion of said pole, said undulating curves being evenly spaced apart and distributed upwardly from said bottom end to define an alternating sequence of peaks and valleys such that said gripping portion is configured to be gripped by fingers of the user having each of the user's fingers positioned within an associated one of said valleys;

a housing coupled to said pole such that said housing is configured to be elevated above the user when the user holds said pole such that said housing is visible to traffic, said housing having an outer wall extending between a front wall and a back wall of said housing, each of said front wall and said back wall having a translucent section extending laterally across an entire width of each of said front wall and back wall, said translucent sections being centrally positioned on each of said front wall and said back wall, each of said translucent sections having indicia printed thereon such that said indicia is configured to be visible to traffic, each of said front wall and said back wall having a plurality of intersecting sides such that said housing has a octagonal shape, a bottom side of said housing being coupled to said top end of said pole;

a control circuit positioned within said housing;

a plurality of light emitters coupled to said housing, said light emitters illuminating said housing wherein said light emitters are configured to make said housing easily visible to the traffic, each of said light emitters being electrically coupled to said control circuit, said light emitters comprising a front set and a back set of light emitters, each of said front and back sets of light emitters including a pair of light emitters, each of a first one and a second one of said front set of light emitters being coupled to an inside surface of said front wall such that said indicia on said front wall is illuminated, each of a first one and a second one of said back set of light emitters being coupled to an inside surface of said back wall such that said indicia on said back wall is illuminated;

a pair of lenses coupled to said housing such that said lenses are illuminated by said light emitters, each of said lenses being positioned on an associated one of said front wall and said back wall, each of said lenses being aligned with said second one of an associated one of said sets of light emitters;

a pair of speakers coupled to said housing wherein said speakers are configured to emit an audible warning to the traffic, each of said speakers being electrically coupled to said control circuit, each of said speakers being positioned on an associated one of said front wall and said back wall;

an actuator coupled to said pole, said actuator being electrically coupled to said control circuit;

a power supply positioned within said pole, said power supply being electrically coupled to said actuator, said power supply comprising a plurality of batteries; and a plurality of photovoltaic cells coupled to said outer wall of housing wherein said photovoltaic cells are configured to be exposed to sunlight, each of said photovoltaic cells being electrically coupled to said power supply such that said photovoltaic cells charge said power supply.

* * * * *